United States Patent [19]

Beard

[11] 4,303,265

[45] Dec. 1, 1981

[54] LOCK FOR HORIZONTAL SLIDING WINDOW

[76] Inventor: Eugene R. Beard, 3186 Reva Dr., Concord, Calif. 94519

[21] Appl. No.: 126,989

[22] Filed: Mar. 3, 1980

[51] Int. Cl.[3] ..... E05C 1/04

[52] U.S. Cl. ..... 292/145; 292/162; 292/DIG. 20; 292/DIG. 47

[58] Field of Search ..... 292/42, 145, 147, 152, 292/162, 175, DIG. 20, DIG. 35, DIG. 46, DIG. 47

[56] References Cited

U.S. PATENT DOCUMENTS 3,209,411 10/1965 Sprague .
3,698,883 10/1972 Di Fazio ..... 292/147
3,709,539 1/1973 Sodenkamp ..... 292/145
3,975,041 8/1976 Edison .
4,102,545 7/1978 Jay .

*Primary Examiner*—Robert L. Wolfe
*Attorney, Agent, or Firm*—James R. Cypher

[57] ABSTRACT

A lock for a horizontally sliding window including a base member attached to a window sill and a catch member slidably mounted on said base member for movement between a locked and unlocked position. The sliding catch member includes a window rail barrier portion for preventing horizontal sliding of a moveable window sash and a catch portion for preventing vertical movement of the slidable window sash to prevent removal of the entire window sash from the outside of a building.

3 Claims, 7 Drawing Figures

LOCK FOR HORIZONTAL SLIDING WINDOW

BACKGROUND OF THE INVENTION

The present invention relates to a locking device to prevent intruders from sliding or removing the sliding sash of horizontal sliding windows.

Most horizontally sliding windows are constructed so that an intruder can either force the latch or gain entry by simply lifting the entire panel slightly upwardly and then pivoting the window outwardly. An example of a window constructed in this manner is Sprague, U.S. Pat. No. 3,209,411 granted Oct. 5, 1965. Sprague shows a locking member which blocks horizontal relative movement but does not prevent removal of the panel by lifting.

The problem of panel removal was addressed by Edison in U.S. Pat. No. 3,975,041 granted Aug. 17, 1976 with a device which is semi-permanent and must be removed with a screw driver each time the window is to be moved to its full opening.

The problem of sash removal is also recognized in Jay, U.S. Pat No. 4,102,545 granted July 25, 1978. This device, however, requires that a hole be drilled in the window rail and a special "winged" key be inserted through aligned openings. When not locked, the key must be removed and is subject to loss or misplacement.

SUMMARY OF THE INVENTION

The gist of the present invention is the use of a lock in addition to the original lock which is a novel combination of two inter-locking members which can prevent horizontal and vertical movement of a sliding window sash.

The unique feature of the present invention is the fact that both parts of the lock are constructed from a common aluminum extrusion normally used in the construction industry for mounting thin tile-like panels around bath tubs.

An object of the present invention is to provide a simple, inexpensive lock which has only two non-separable parts.

Another object is to provide a lock which can be easily and directly installed without modifying in any way the existing window.

DESCRIPTION OF THE INVENTION

Figure 2:
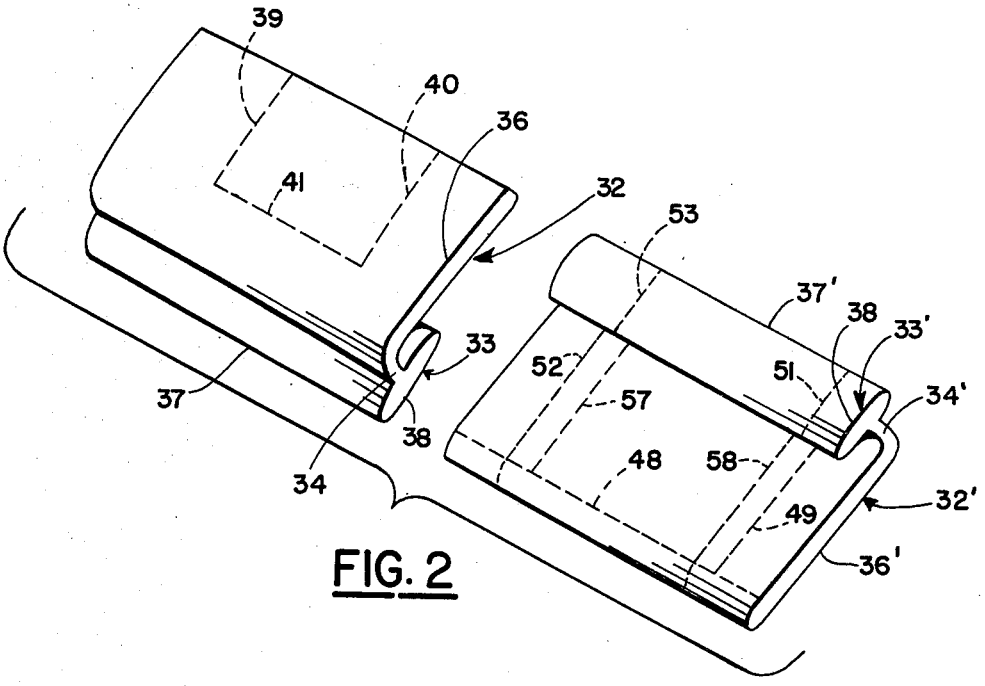
FIG. 2 is a perspective view of prior art standard aluminum extrusions from which the present invention is constructed.
Figure 5:
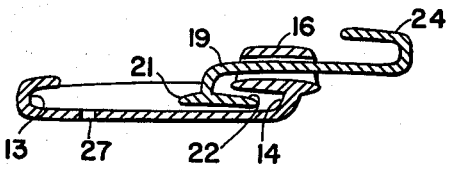
FIG. 5 is a cross sectional view of the lock shown in FIG. 3 taken generally along the line 5—5.
Figure 4:
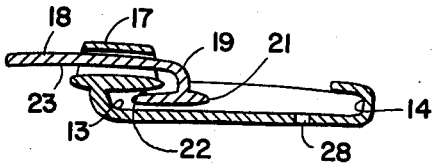
FIG. 4 is a sectional view taken generally along the line 4—4 of FIG. 3.

The lock 1 of the present invention is for a window 2 having a fixed sash 3 and a horizontally sliding sash 4 formed with a stile 6 and a lower rail 7 mounted within a frame 8 including a sill member 9. The lock consists of a base member 11 including a base portion 12 front and rear stop members 13 and 14 attached to the base portion and guide members 16 and 17 attached to the front stop member. A catch member 18 is mounted in sliding registration with the base member between unlocked and locked positions and includes a support portion 19; a rear abutment portion 21 connected to the support portion and mounted for engagement with the rear stop member; a front abutment portion 22 connected to the support portion mounted for engagement with the front stop member; a catch portion 23 mounted on the support portion positioned in sliding registration with one of the guide members 17 and positioned for engagement with the lower rail 7 in the locked position; a barrier member 24 mounted on the support portion positioned in sliding registration with the other of the guide members 16 and positioned for engagement with the stile 6 in the locked position; a finger engagement control member 26 connected to the catch member for movement of the catch member between the unlocked and locked positions and means attaching the base member to the sill member. The means may include openings 27 and 28 and screws 29 and 30.

The lock can be inexpensively constructed since the base and catch members may be formed from identical aluminum extrusions 32 and 32′ as set forth in FIG. 2. These extrusions consists of a T-shaped portion 33 and include a stem member 34 and 34′ and leg portions 36 and 36′ positioned at right angles to the stem member. The distal edge 37 and 37′ of the cross members 38 and 38′ of the extrusion normally rest upon the top surface of a bath tub.

Figure 1:
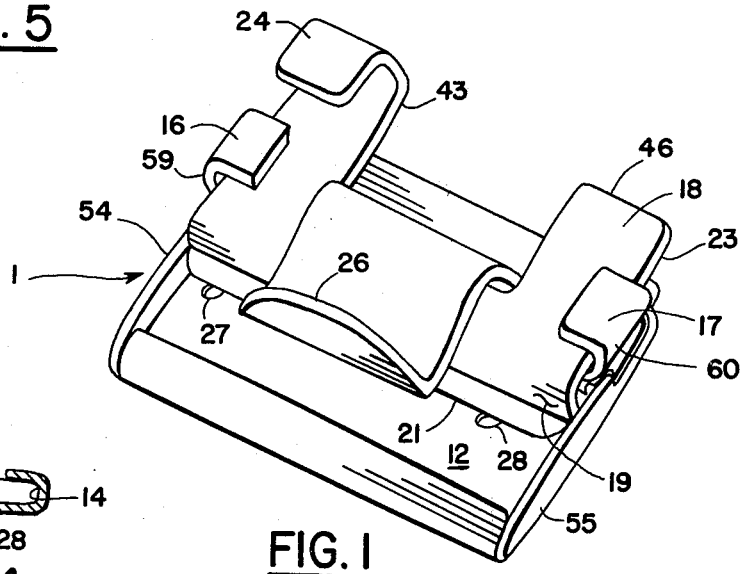
FIG. 1 is a perspective view of the lock of the present invention in the locked position.
Figure 6:
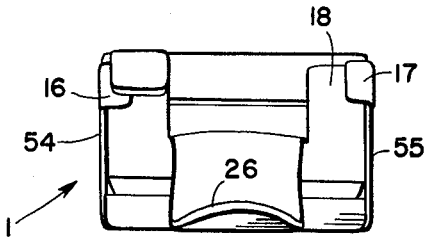
FIG. 6 is a top plan view of the lock in the unlocked position.
Figure 3:
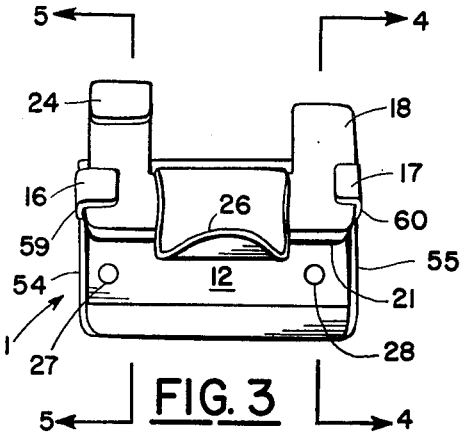
FIG. 3 is a top plan view of the lock in the locked position.
Figure 7:
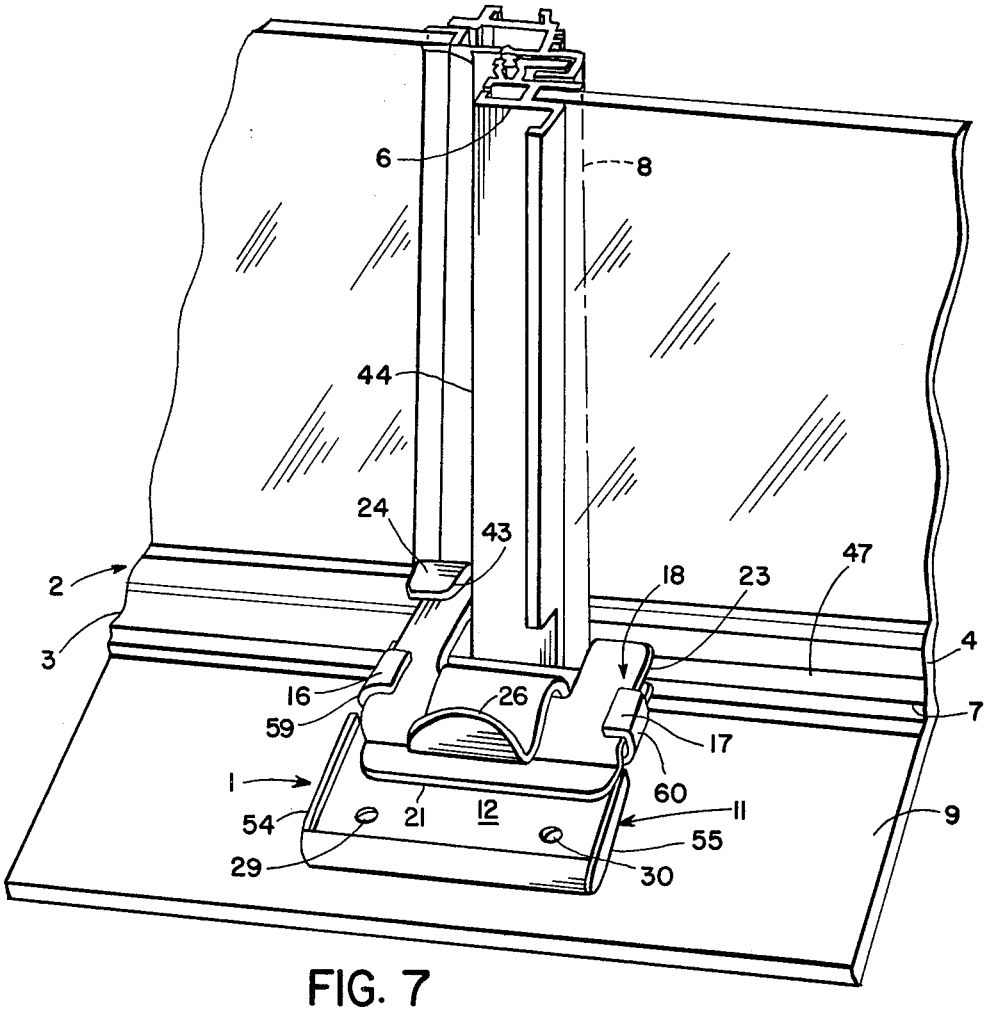
FIG. 7 is a perspective view of the lock of the present invention installed in a horizontal window with the lock in the locked position.

The leg portion is fastened against a stud frame member and a thin structural member (usually immitation tile) rests against the edge of the stem member and between the cross member and the leg member. Referring to FIGS. 1 and 2, it may be seen that the catch member may be made from extrusion member 32 by simply cutting the leg member 36 along dotted lines 39 and 40 and bending the finger engagable control member along dotted line 41. Guide member 16 may be constructed by bending a portion of the leg member as shown in FIG. 1 forming a J-shaped portion with an edge 43 adapted to engage edge 44 of the window stile 6. The catch portion 18 is cut at edge 46 so that the catch portion 23 engages the top face 47 of lower rail member 7.

The base member shown in FIG. 1 is made from extrusion 32′ shown in FIG. 2. The rear stop member 14 is formed by bending leg portion 36′ upwardly along dotted line 48. The guide member 17 is formed by cutting the leg and stem members along dotted line 49 and then bending the cross member of the T-shaped member along dotted line 51.

The other guide member 16 is formed by cutting the leg and stem members along dotted line 52 and bending the cross member of the T-shaped member along dotted line 53.

Side members 54 and 55 are formed along the leg member of the extrusions by folding inwardly along dotted lines 57 and 58.

The base member is attached to the sill base of the window frame by inserting screws or nails through openings 27 and 28 formed in the base portion of the base member. In the unlocked position, the rear stop member 14 is in approximate touching engagement with the rear abutment portion 21 of the catch member. To lock the horizontally slidable sash 4, the finger engagement member 26 is grasped and moved toward the stile of the window sash until the barrier member 24 is in engagement with the stile and the catch portion 23 is in engagement with the top face 47 of the lower rail 7. To unlock the sliding window sash, the opposite procedure is followed.

No springs are necessary if the barrier member 24 and catch member 18 are in close frictional engagement with guide members 16 and 17.

Side members 54 and 55 and side portions 59 and 60 of the guide members prevent the catch member from moving laterally with respect to the base member. The guide members 16 and 17 prevent the barrier member 24 and the catch member 18 from moving vertically with respect to one another.

The lock is used in conjunction with and does not replace the standard window lock. The lock of the present invention is preferably installed after the entire window has been installed.

The lock is preferably made of aluminum but may be made of other types of metal.

In the event that a burglar forces frame 8 upwardly, the catch 23 will bend upwardly around guide 17. This will prevent any sliding movement of catch member 18 in relation to base member 11. Catch portion 23 is designed so that when frame 8 reaches its upward limit of movement, it will remain in engagement with top face 47 of frame 8. Thus, with frame 8 moved to its upper limit, even though a space will now occur between lower rail 7 and sill 9, a screw driver or other instrument can not slide catch member 18 which is now permanently locked with respect to base member 11. In conclusion, forcing the frame 8 merely locks the window more securely.

I claim:

1. A lock for a window having a fixed sash and a horizontally slidable sash formed with a stile and a lower rail mounted within a frame including a sill member, said lock comprising:

a. a base member including a base portion, front and rear stop members attached to said base portion and guide members attached to said front stop member;

b. a catch member mounted in sliding registration with said base member between unlocked and locked positions including, (1) a support portion, (2) a rear abutment portion connected to said support portion mounted for engagement with said rear stop member, (3) a front abutment portion connected to said support portion mounted for engagement with said front stop member, (4) a catch portion mounted on said support portion positioned in sliding registration with one of said guide members and positioned for engagement with said bottom rail in said locked position;

(5) a barrier member mounted on said support portion positioned in sliding registration with the other of said guide members and positioned for engagement with said stile in said locked position, (6) a finger engageable control member connected to said catch member for movement of said catch member between said unlocked and locked positions; and c. means attaching said base member to said sill member.

2. A lock as described in claim 1 wherein;

a. said base and catch members are formed from identical aluminum extrusions having a T-shaped portion including a stem member and a leg portion positioned at right angles to said stem member.

3. A lock as described in claim 1 comprising:

a. side members attached to opposite sides of said base portion of said base member.

* * * * *